US006193120B1

(12) United States Patent
Chang

(10) Patent No.: US 6,193,120 B1
(45) Date of Patent: Feb. 27, 2001

(54) WAIST-SECURED GOLF BALL RETAINER

(76) Inventor: Chen-Te Chang, No. 6, Lane 49, Jen-I Street, Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 09/365,763

(22) Filed: Aug. 3, 1999

(51) Int. Cl.[7] ..... A45F 5/00

(52) U.S. Cl. ..... 224/245; 224/919; 224/918; 224/247; 224/679; 224/680; 206/315.9; D3/221; D3/257

(58) Field of Search ..... 224/918, 919, 224/242, 245, 247, 248, 676, 678, 679, 682, 666, 680; 206/315.9; D3/221, 257

(56) References Cited

U.S. PATENT DOCUMENTS 1,756,677 * 4/1930 Cook ..... 224/245
2,548,330 * 4/1951 Wiseman ..... 224/247 X
4,339,120 * 7/1982 Czarny ..... 224/919 X
4,730,728 * 3/1988 Larkin ..... 224/918 X
4,784,305 * 11/1988 Schoenberg ..... 224/918 X
5,074,448 * 12/1991 Wu ..... 224/919 X
5,261,583 * 11/1993 Long et al. ..... 224/245
5,423,530 * 6/1995 Alverez Gonzalez ..... 224/918 X
5,435,474 * 7/1995 Lin ..... 224/919 X

* cited by examiner

*Primary Examiner*—Gregory M. Vidovich
(74) *Attorney, Agent, or Firm*—Bacon & Thomas, PLLC

(57) ABSTRACT

A waist-secured golf ball retainer comprises at least a ball cup for loading a golf ball, wherein a snap clamp disposed at the circumference of the ball cup clamps at a player's waistband; an opening formed in bottom end of the ball cup; a plurality of equally spaced π cuts arranged in wall of the ball cup for forming a plurality of elastic snap pieces, wherein the root end of each elastic snap piece is connected with the cup wall and the top end is movable; a protruded snap-pressing arc edge is formed at the top end of each elastic snap piece for snap-pressing the golf ball; two ball cups being combinable via a continuous face to form the retainer wherein a plurality of receptacles and a storage hole are disposed in the top face while a storage groove in a lateral end of the continuous face respectively; and by the above construction, an easy loading or unloading, a stable clamping of the retainer to a player waistband, and a long lifetime for using the retainer being made possible without needing worry of escape of the golf ball.

9 Claims, 6 Drawing Sheets

WAIST-SECURED GOLF BALL RETAINER

BACKGROUND OF THE INVENTION

This invention relates to a golf appliance, more particularly, to a waist-secured golf ball retainer for retaining a golf ball when playing.

A waist-secured golf ball retainer is a golf appliance facilitating a golf player to carry a spare golf ball with himself for replenishment. In general, it is already known that a golf course is a large-scale sport site, hence, occasionally, a player may get in trouble groping for the ball hit to fly into a cluster of bush or some elsewhere if he doesn't have a spare ball at hand that may incur some impatient players becoming displeased.

FIGS. 1 and 2 express two prior waist-secured golf ball retainers in different types.

In FIG. 1, the ball retainer contains a folded clamp for being hooked to a waistband, wherein a semi-circular 1st snap clamp is disposed at a lower half of the folded clamp; a 2nd snap clamp is cross-jointed with the 1st snap clamp by a screw element to provide a space for accommodating a golf ball; and, an accessory belt with a plurality of U-shaped holders is disposed transversely at an upper half of the folded clamp for holding tees.

After a golf ball is loaded in abovesaid ball retainer, the ball's weight is mostly concentrating on the lower branch of the 1st snap clamp to make the same pendent gradually owing to imbalance of weight distribution. In addition, the lower branch is usually somewhat pressed downwards when loading or unloading a golf ball that may deteriorate pendency of the 1st snap clamp. Moreover, the golf ball is held at four points in the cavity enclosed by the 1st and the 2nd snap clamp, therefore, in case any snap clamp thereof is deformed, the golf ball may escape from the cavity. Nevertheless, as abovesaid four support points are isolated from each other without any reinforcement auxiliary components, the golf ball clamp devices are liable to be deformed due to overlapped bags in transportation.

In regard to fabrication and assembling of the ball retainer, it requires a plurality of moldings for forming the folded clamp, the 2nd snap clamp, and the accessory belt respectively, which are then assembled by human labor at considerable cost.

As shown in FIG. 2, a ball retainer made of a soft material contains an integrally molded bag piece with a plurality of cup-shaped bags and receptacles, wherein the diameter of each bag opening is slightly shorter than that of a golf ball to prevent the ball in the cavity from escaping; another opening is formed at a front face of each bag with cooperative laterally disposed protruded dots for squeezing out the spare ball; the receptacles are prepared for plugging the tees; and, two through slots are reserved for penetrably disposing a player's waistband.

As the foregoing mentioned ball retainer is made of a soft material for squeezing purpose, however, it can not be clamped on a player's waistband at anytime or anywhere if desired, and instead, the player can wear it only in some designated places, such as a closet. Further, the spare golf balls are loaded in the bags, the weight of the balls may deform the soft bags, which will sway following movement of the player and slap his waist from time to time to obviously influence feelings and atmosphere.

SUMMARY OF THE INVENTION

The primary object of this invention is to provide a waist-secured ball retainer made of a hard and elastic material by integral molding with long lifetime for time and labor saving, cost reducing, convenient ball retaining without escaping, and easy ball releasing.

Another object of this invention is to provide a waist-secured ball retainer that can accommodate a trimmer, label nails, and tees, etc in addition to golf balls.

In order to achieve above objects, this invention is embodied in a waist-secured golf ball retainer comprising: at least a ball cup for loading a golf ball; a snap clamp disposed at the circumferential edge of the ball cup for clamping at a player's waistband; an opening formed in bottom end of the ball cup; a plurality of equally spaced $\pi$ cuts arranged in a wall of the ball cup for forming a plurality of elastic snap pieces, wherein the root end of each elastic snap piece is connected with the cup wall and the top end is movable; a protruded snap-pressing arc edge is formed at the top end of each elastic snap piece for snap-pressing the golf ball; two ball cups being combinable via a continuous face to form the retainer, wherein a plurality of receptacles and a storage hole are disposed in the top face while a storage groove in a lateral end of the continuous face respectively; and by the above construction, an easy loading or unloading, a stable clamping of the retainer to a player waistband, and a long lifetime for using the retainer being made possible without needing worry of escape of the golf ball.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

A waist-secured ball retainer of this invention mainly comprises at least a ball cup 30 and a snap clamp 40 provided to the ball cup 30 at its outer rim for snap clamping to a player's waistband.

Figure 1:
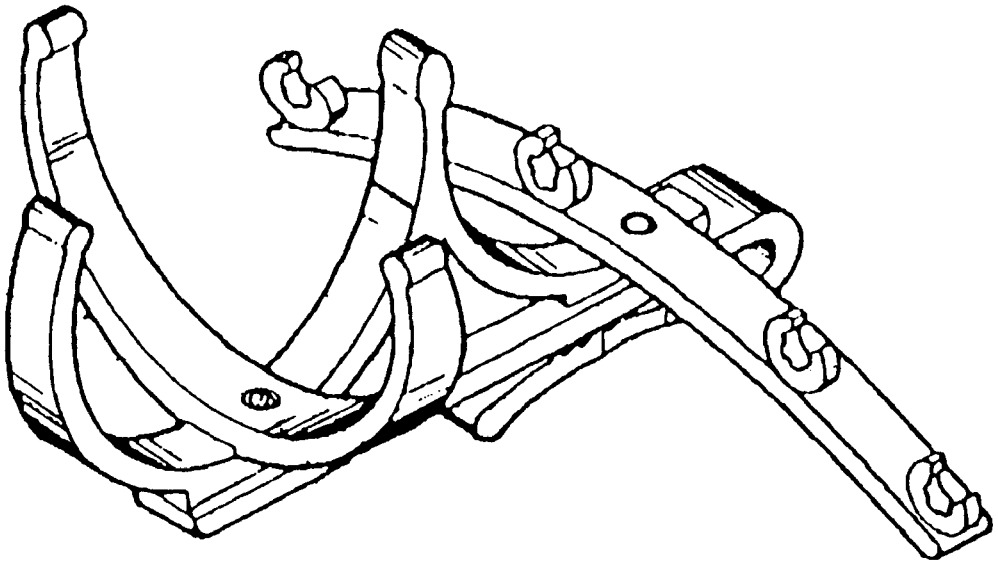
Fig. 1 PRIOR ART
FIG. 1 is an external view of a prior ball retainer.
Figure 2:
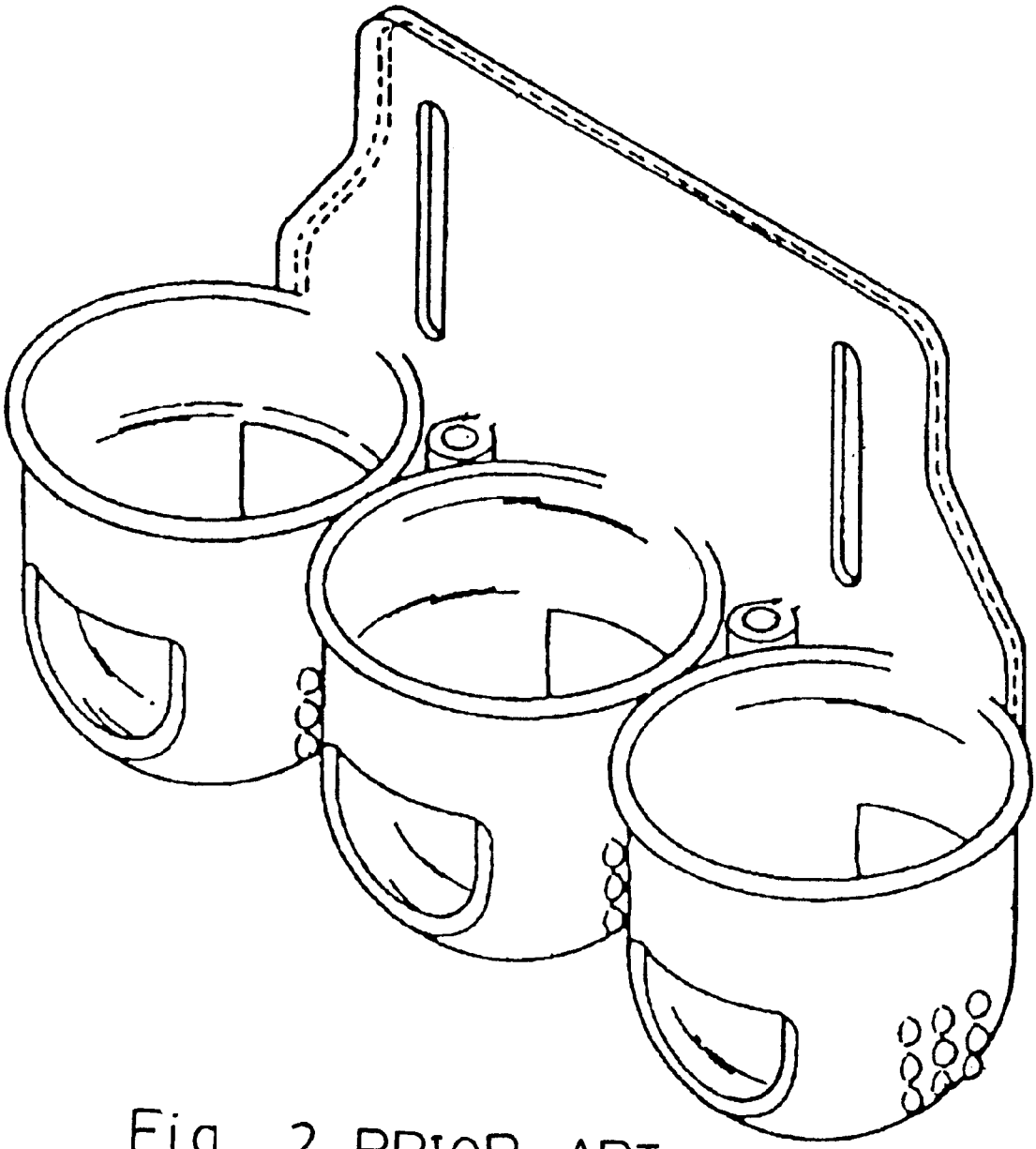
Fig. 2 PRIOR ART
FIG. 2 is an external view of another prior ball retainer.
Figure 3:
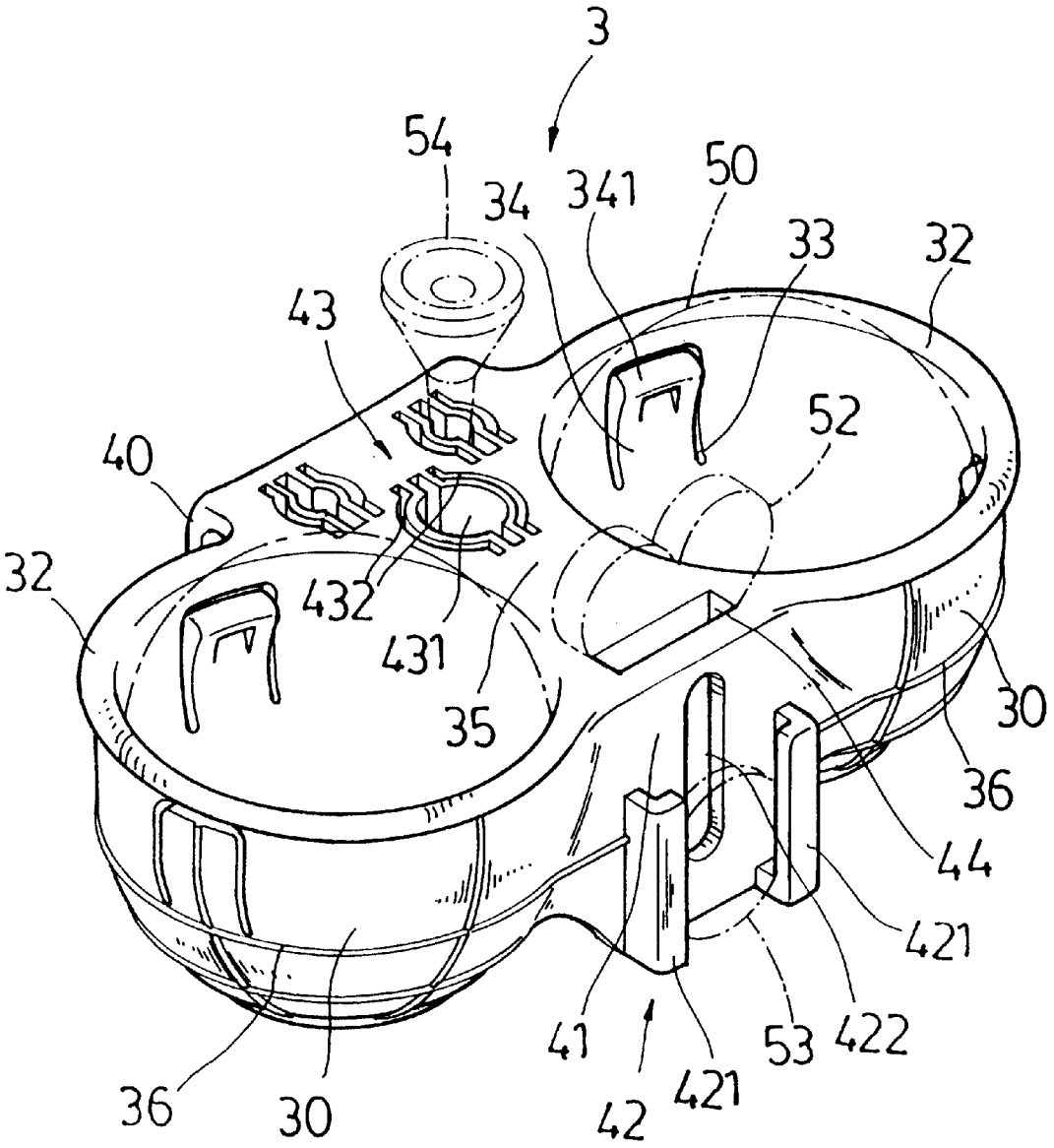
FIG. 3 is a three-dimension external view of a 1st embodiment of this invention.
Figure 6:
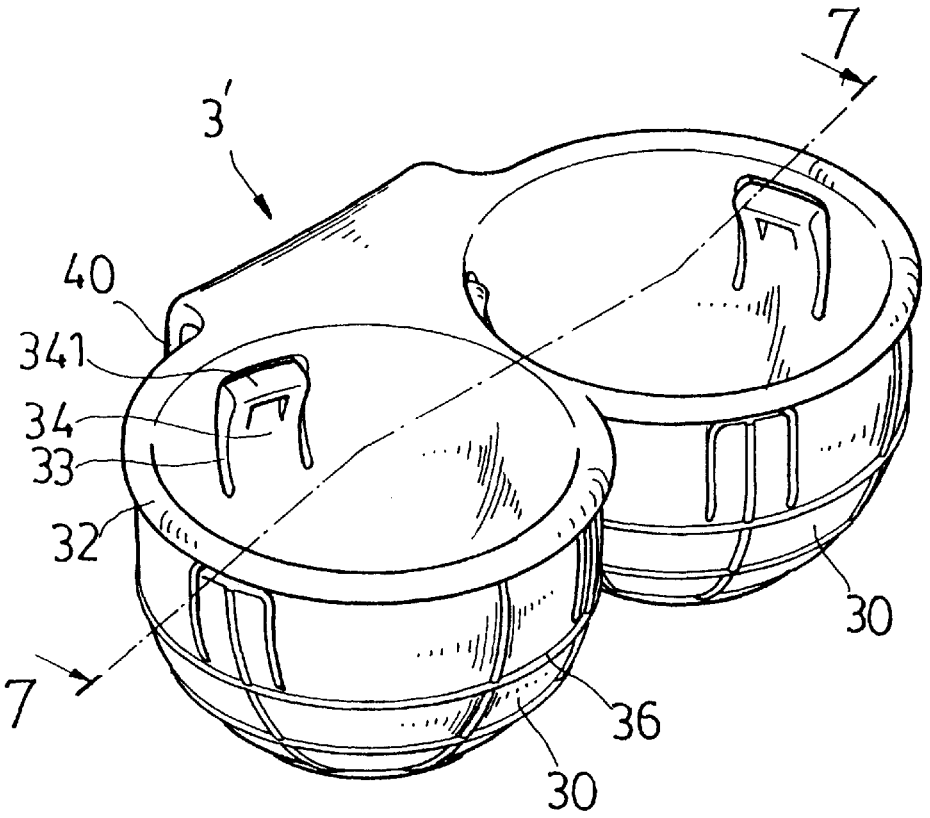
FIG. 6 is a three-dimension external view of a 2nd embodiment of this invention.
Figure 8:
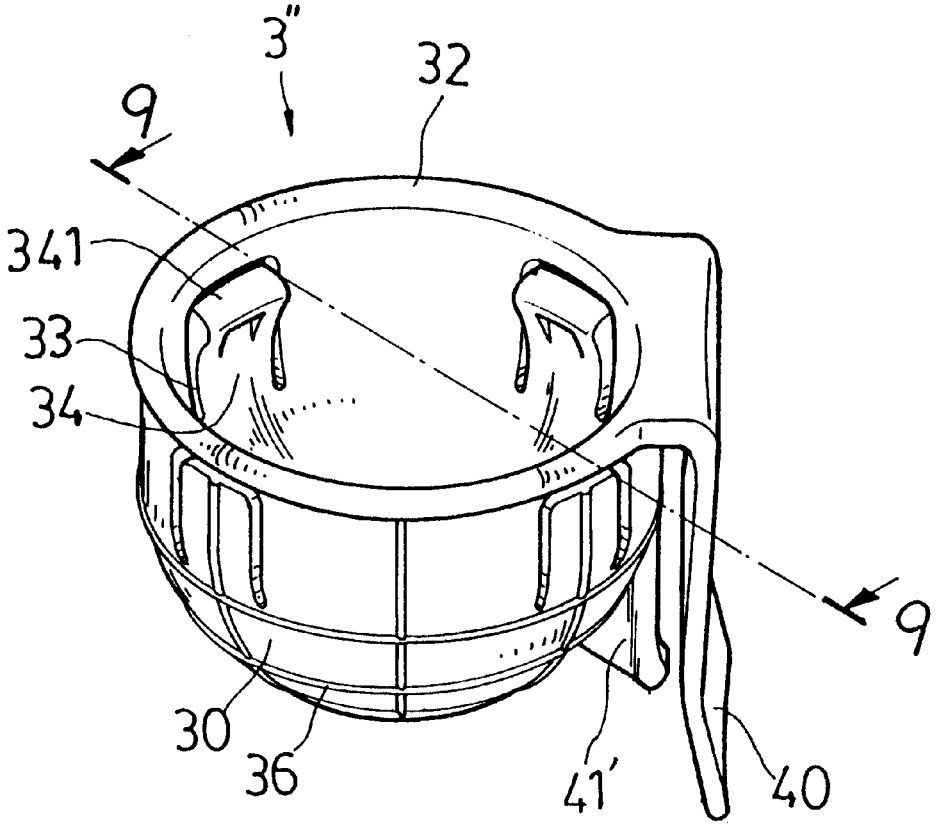
FIG. 8 is a three-dimension external view of a 3rd embodiment of this invention.

As shown in FIGS. 3, 6, and 8, the ball cup 30 is a tapered bowl with a relatively wider opening in its top portion, another circular opening 31 is formed in its bottom end at center portion. A flange 32 is formed at circumferential rim of the top opening, and an inner diameter of the top opening is correspondent with that of a golf ball 50. In virtue of a plurality of equally spaced $\pi$ type cuts 33 formed in the cup wall of the ball cup 30, an elastic snap piece 34 with its root anchored at the cup wall while its top end elastically movable is formed fitting each cut 33, wherein a top end of the elastic snap piece 34 is protruded inwards to form a snap-pressing edge 341; a diameter of a circle enclosed by the snap-pressing edges 341 is slightly shorter than that of the golf ball 50; and a plurality of rib stripes formed in longitudinal and latitudinal direction is for decoration purpose.

When loading a golf ball 50 into the ball cup 30 through the top opening thereof, the flange 32 functions to smooth the loading action to lessen wearing of the golf ball 50. At that time, when the golf ball 50 is about to contact the top end of the elastic snap piece 34, a player is supposed to exert a proper force to push the golf ball 50 downwardly to have the elastic snap pieces 34 moved outwardly to permit the golf ball 50 to enter the ball cup 30 thoroughly, and no sooner has it done than the elastic snap piece 34 returns by an elastic restoring force to enable the snap-pressing edges 341 to clutch at the golf ball 50 without scraping surface thereof.

On the contrary, when unloading the golf ball 50 is desired, a player is supposed to stretch merely a finger or two into the bottom opening 31 and thrust the golf ball 50 upwards to have the job immediately done. At this time, the player's finger(s) can be in no way to get hurt due to roundness of the opening 31 edge.

According to the abovesaid main basic structure, some other diversified embodiments may be derived for this invention.

Figure 4:
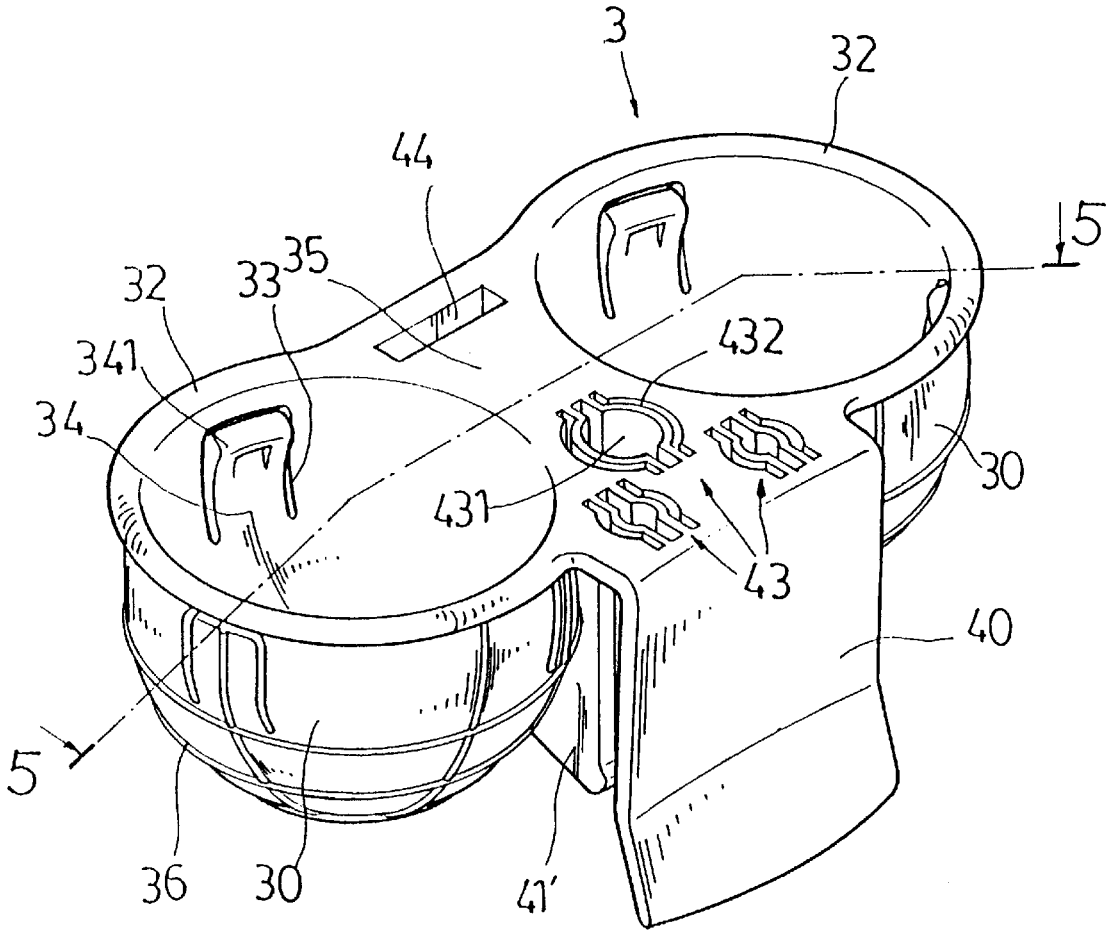
FIG. 4 is another three-dimension external view of the 1st embodiment of this invention.
Figure 5:
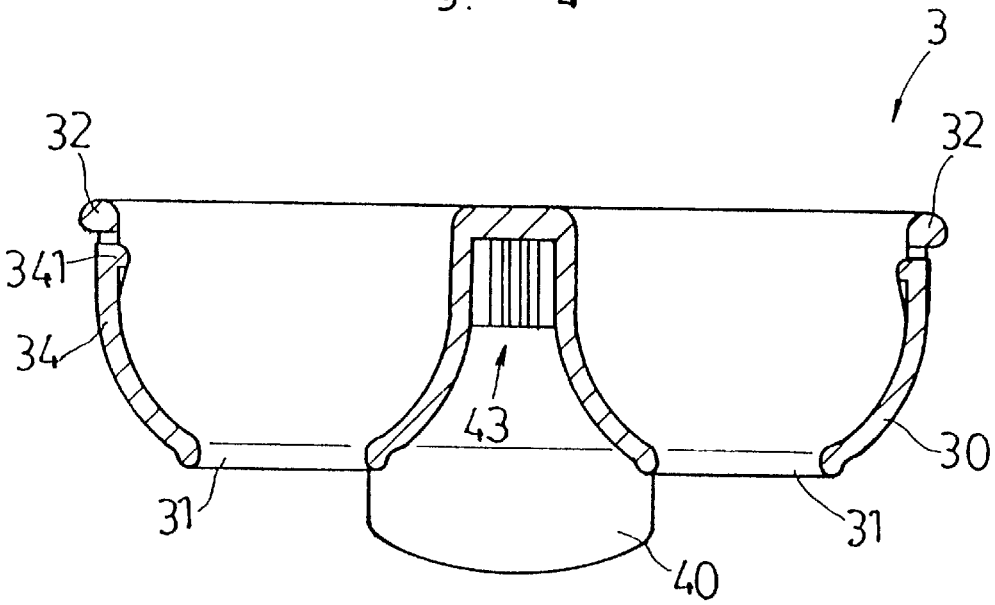
FIG. 5 is a cutaway sectional view along line 5—5 in FIG. 4.

As shown in FIGS. 3, 4, and 5, the ball retainer 3 comprises two ball cups 30 spaced in some interval and connected with a continuous top face 35, wherein two open ends of the continuous face 35 are extended and turned downwards to form a lateral wall 41 and a lateral piece 41', and the end adjacent to the lateral piece 41' is again extended and turned downwards to form a snap clamp 40 which is cooperative with the lateral piece 41' for clamping at a player's waistband; a storage groove 42 formed on an external face of the lateral wall 41 contains a pair of L type wall pieces 421 with closed bottom ends to form an enclosed space for guiding and accommodating some flat and thin subordinate accessories, such as a label nail 53; and a through slot 422 is prepared in the face of the lateral wall 41 commensurate with the wall pieces 421 for reception shank of a label nail 53.

A plurality of receptacles 43 in different sizes is disposed in the continuous top face 35 near the end of the snap clamp 40, wherein an insertion hole 431 is formed the center portion of each receptacle 43 for inserting a tee 54; two opposite positions in circumference of each insertion hole 431 are trenched outwards in a direction perpendicular to an upper edge of the snap clamp 40 to enhance its elastic expandability; and two lateral slots 432 in same curvature are formed aside each insertion hole 431 for enhancing its elastic expandability in a direction orthogonal to that of the trenched work for placing a tee 54 therein. Further, a storage hole 44 is disposed in the continuous face 35 at a position near the storage groove 42 for depositing accessories, such as a trimmer 52, etc.

Figure 7:
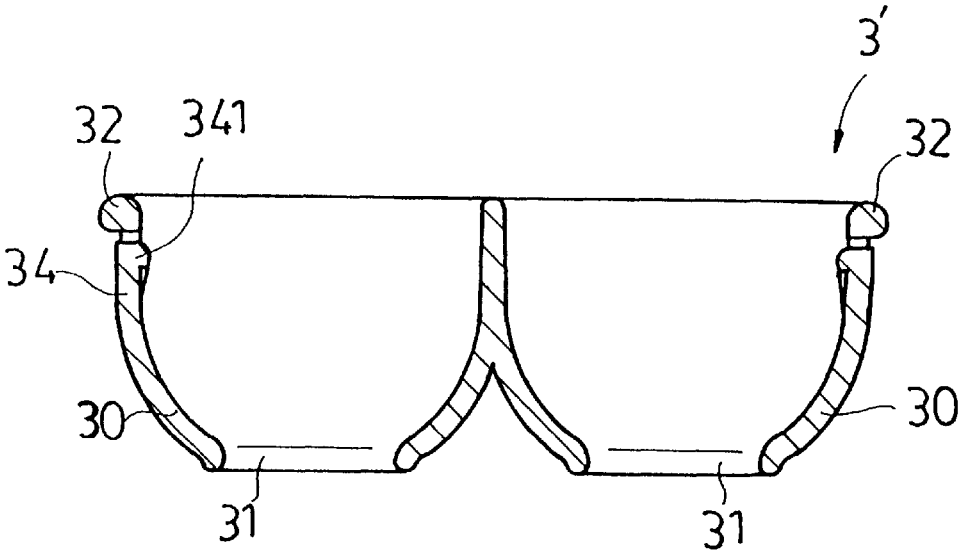
FIG. 7 is a cutaway sectional view along line 7—7 in FIG. 6.

As shown in FIGS. 6 and 7, the ball retainer 3' comprises two ball cups 30 aligned arm in arm, and the top face between those two ball cups 30 is extended and turned downwards to form the snap clamp 40.

Figure 9:
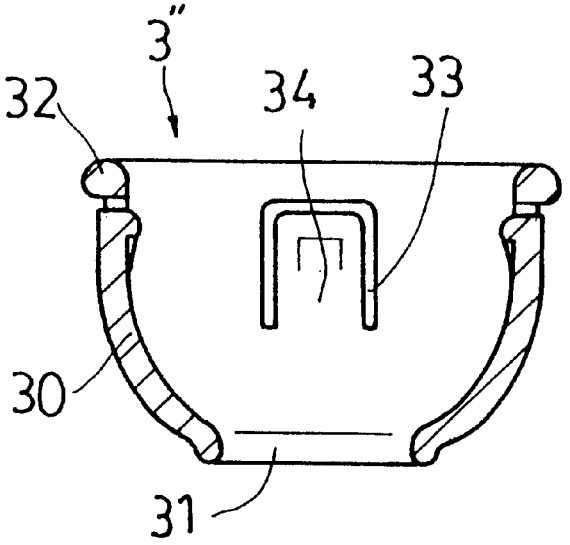
FIG. 9 is a cutaway sectional view along line 9—9 in FIG. 8.

As FIGS. 8 and 9 indicate, the ball retainer 3" contains a ball cup 30 only, wherein four elastic snap pieces 34 are equally spaced in the inner wall of the ball cup 30, and partial top face is extended and turned downwards to form the snap clamp 40.

According to the foregoing described and related embodiments, the merits of this invention are summarized as the following:

1. The ball retainer of this invention is integrally made of a hard and elastic material that is advantageous in saving time, labor, and cost.
2. A simple way for loading or unloading a golf ball into or from the retainer merely by pressing the golf ball downwards or upwards.
3. The flange formed along circumference of the ball cup is capable of strengthening the structure of the ball cup in addition to guiding a golf ball to enter the storage room without scraping.
4. The plurality of elastic snap pieces in the ball cup is formed by cutting the inner wall of the ball cup in π shape with excellent elasticity for snap-clamping a golf ball without needing worry of escaping.
5. The snap-pressing edges of the elastic snap pieces facilitate a smooth action of squeezing down or up a golf ball, and clamp it without scraping.
6. An easy mounting or dismounting manner of the retainer by clamping the snap clamp directly to a player's waist. The arc configuration of the snap clamp offers comfortableness and convenience for wearing.
7. As the retainer is integrally made of a hard and elastic material, it will neither be deformed by weight of golf balls, nor will it sway to slap the waist and influence the striking action. A long lifetime of the ball cups and a golf ball protecting function are expectable.
8. In addition to accommodating golf balls, the ball retainer of this invention further comprises the storage groove, receptacles, and storage hole, etc for reception of other accessories, such as label nails, trimmer, and tees, particularly, the specially designed receptacles can hold the tees firmly without needing worry of escape of the golf balls.
9. Due to an excellent structural strength of this invention, when the golf bags are overlapped and piled up in a car for transportation, the retainers will keep themselves in form without impairment.

What is claimed is:

1. A waist-secured golf ball retainer, comprising at least a ball cup for loading a golf ball and a snap clamp provided to said ball cup at its circumferential edge for clamping at a player's waistband; characterized in that said ball retainer is made of a hard elastic material;

a bottom opening is formed in said ball cup at a center portion of its bottom end; a plurality of equally spaced π cuts are made around and within the cup wall of said ball cup for forming a plurality of elastic snap pieces corresponding with said cuts, wherein the root of each elastic snap piece is connected with the cup wall while its top end is movable;

a plurality of snap-pressing edges is formed by the top ends of said elastic snap pieces protruded from the cup wall for elastically snap-pressing the golf ball.

2. The waist-secured golf ball retainer of claim 1, wherein said at least a ball cup comprising two ball cups spaced and connected by a continuous top face.

3. The waist-secured golf ball retainer of claim 2, wherein opposing ends of said continuous top face are extended and turned downwards to form a lateral wall and a lateral piece respectively; and the end of said continuous top face adjacent to said lateral piece is further extended and turned to form said snap clamp; and a storage groove is formed externally in front of said lateral wall.

4. The waist-secured golf ball retainer of claim 3, wherein said storage groove mainly comprises two L type wall pieces formed by protruding the left and the right side of said lateral wall outwardly and, correspondingly, the bottom end of each said L type wall piece is closed; and between those two L type wall pieces, a through slot is disposed in said lateral wall.

5. The waist-secured golf ball retainer of claim 2, wherein a plurality of receptacles are formed in said continuous top face; an insertion hole is centered in each said receptacle; said insertion hole is entrenched outwardly to form a trench at two opposite circumferential positions respectively in a direction perpendicular to the face of said snap clamp; and two symmetrical curved slots concentric to said insertion hole are defined laterally thereto without enclosing said trenches.

6. The waist-secured golf ball retainer of claim 2, wherein said continuous top face is provided with a storage hole.

7. The waist-secured golf ball retainer of claim 1, wherein said at least a ball cup comprising two ball cups with a center portion therebetween, said center portion including a portion which is extended and turned downwards to form said snap clamp.

8. The waist-secured golf ball retainer of claim 1, wherein the wall around said bottom opening is convex.

9. The waist-secured golf ball retainer of claim 1, wherein a circular flange is formed at circumference of a top opening in each said ball cup.

* * * * *